United States Patent [19]

Root et al.

[11] Patent Number: 4,475,786

[45] Date of Patent: Oct. 9, 1984

[54] T BAR COVER LATCH

[75] Inventors: John A. Root, Middletown; Michael J. Scully, Harrisburg, both of Pa.

[73] Assignee: AMP Incorporated, Harrisburg, Pa.

[21] Appl. No.: 415,286

[22] Filed: Sep. 7, 1982

[51] Int. Cl.[3] ..... H01R 13/36

[52] U.S. Cl. ..... 339/99 R

[58] Field of Search ..... 339/97 R, 97 P, 98, 339/99 R

[56] References Cited

U.S. PATENT DOCUMENTS

| | | | |
|---|---|---|---|
| 3,317,989 | 5/1967 | Cull . | |
| 3,820,055 | 6/1974 | Huffnagle et al. | 339/97 P |
| 4,111,512 | 9/1978 | Parmer et al. . | |
| 4,241,970 | 12/1980 | Rider et al. . | |
| 4,359,257 | 11/1982 | Lopinski et al. . | |

FOREIGN PATENT DOCUMENTS

| | | | |
|---|---|---|---|
| 2002599 | 2/1979 | United Kingdom | 339/99 R |

*Primary Examiner*—Joseph H. McGlynn

*Attorney, Agent, or Firm*—Russell J. Egan

[57] ABSTRACT

A cover latching assembly is formed by elongated grooves in opposite ends of a connector housing, the grooves extending between mating and rear surfaces of the housing and having a bridge spanning each groove intermediate the length thereof. Each bridge has a straight side directed toward the rear surface and a profiled side directed toward the mating surface. The cover has depending leg portions received in the respective grooves and engaging with the profiled side so as to have the cover spaced above the rear surface or closely adjacent the rear surface.

2 Claims, 3 Drawing Figures

T BAR COVER LATCH

The present invention relates to a cover latching assembly for miniature electrical connectors which assembly will allow the cover to be positively positioned in either of two conditions, with respect to the associated housing, and which will further provide gripping means for associate tooling to readily remove the connector from a mated condition.

It is preferable, in connectors having insulation piercing terminals, to have a cover adapted for two position mounting with respect to the associated housing. In the first position the cover is spaced above the connector housing so that a cable can be received between the cover and the terminals carried by the housing and subsequently terminated in a single operation with the cover assuming a second closed position. The known connector housings and covers have some configuration at the ends of the connector which accommodate the latching together of the cover and the connector housing. These configurations are not always readily suitable for enagement by a tool which allow the connector to be withdrawn from a mated position, and in particular when the mated connector is in a high density mated situation. In such a situation it is necessary for the ends of the connector to be provided with a configuration which will allow gripping by an extraction tool thereby enabling the unmating of the connector without damage to the connector or the cable it is terminating.

The present invention concerns an improved latching configuration for attaching a cover to an electrical connector housing having a profiled channel at each end of the connector housing extending between a mating face and a rear surface with a transverse bridge extending across an intermediate portion of each channel. A cable cover has a latching leg configuration depending from each end to be received in a respective channel of the housing. Each latching leg configuration is formed by a pair of legs defining a slot therebetween and having outwardly directed shoulders on the free end of each leg, lugs adjacent the closed end of the slot and extending normal to the plane of the legs, and a transverse abutment spaced from the legs. Each bridge has a first straight side directed toward the rear surface and a second profiled side directed toward the mating face. The profile includes a pair of shoulders spaced from the first side and a recessed portion parallel to and spaced from the first side and lateral recesses at each opposite end thereof. The outwardly directed shoulders of the legs engage in either the lateral recesses and, together with the lugs engaging the first side of the bridge, hold the cover in an open condition, or with the second side of the bridge to hold the cover in a closed condition, the lugs being wiped off by the bridge in the closing operation.

The present invention will be described by way of non-limiting example with reference to the accompanying drawings in which.

Figure 1:
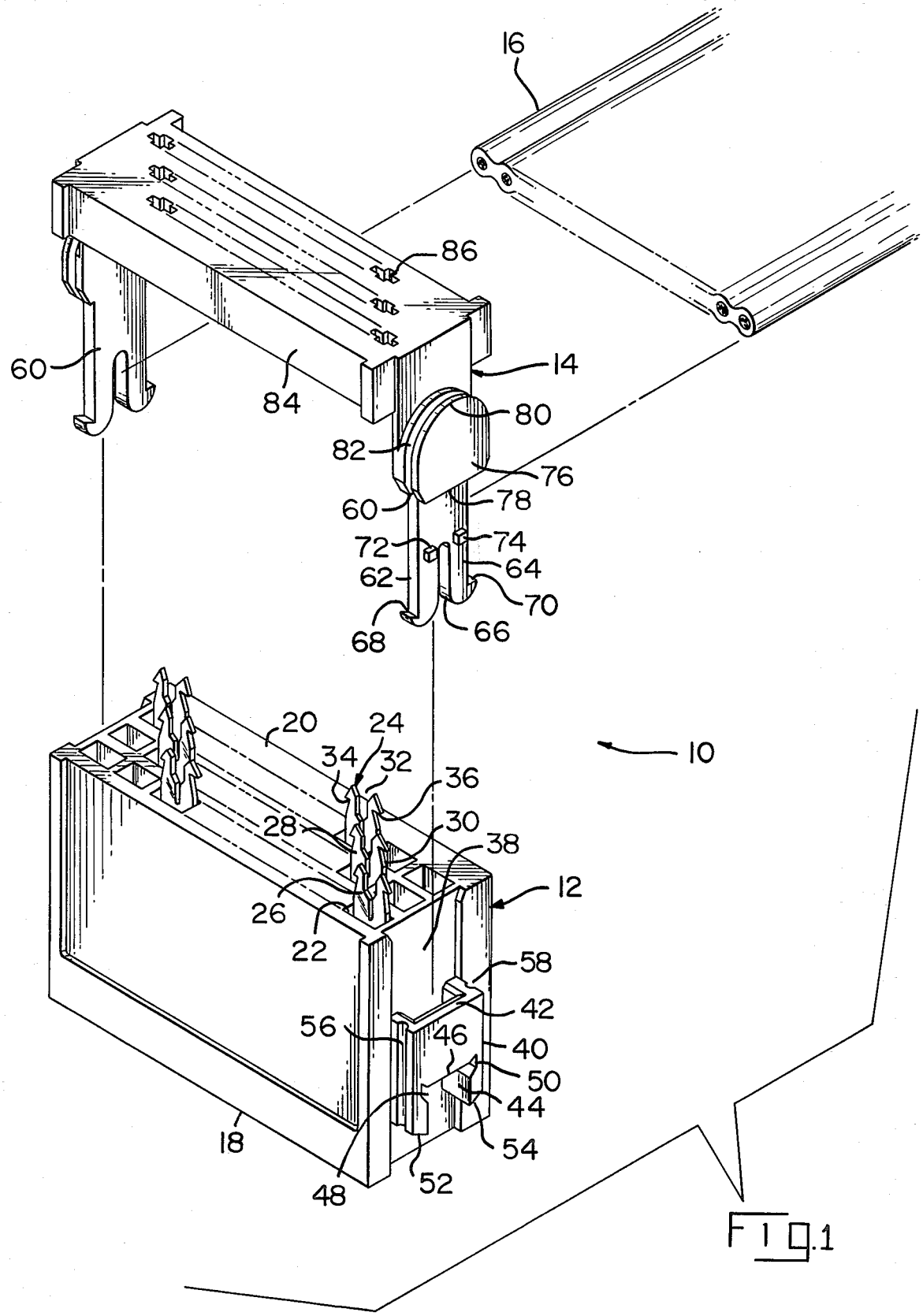
FIG. 1 is an exploded perspective view of the subject invention.

The subject connector 10 is formed by a housing 12 and a cover 14 and is used to terminate a multi-conductor flat or ribbon cable 16. The housing 12 is made of a rigid insulative material and has a mating face 18 and an oppositely directed rear surface 20 with a plurality of terminal passages 22 extending therebetween. A plurality of terminals 24 are mounted in the respective passages each with a mating portion (not shown) directed towards the mating face 18 and an insulation piercing, conductor engaging portion 26 extending from the rear surface 20. Portions 26 preferably are formed by a pair of tines 28, 30 defining a slot 32 therebetween and having outwardly directed shoulders 34, 36, respectively, on the free ends of the tines 28, 30. At each end of the housing there is a channel 38 having a bridge 40 spanning a portion thereof intermediate the mating face 18 and rear surface 20. The bridge 40 has a first straight side 42 directed towards the rear surface 20 and a profiled side 44 directed towards the mating face 18 of the connector. Profiled side 44 has a wall 46 parallel to and spaced from side 42, lateral recesses 48, 50 at the ends of wall 46 and shoulders 52, 54 spaced from wall 46. The bridge also includes exterior side grooves 56, 58.

The cover 14 has, at each end, thereof a depending leg portion 60 which includes a free end a pair of legs 62, 64 separated by a slot 66, an outwardly directed shoulders 68, 70 on the free ends of leg 62, 64, respectively, and lugs 72, 74 integral with the leg portions, and closely adjacent the closed end of the slot 66, and outwardly directed of the plane defined by the legs 62, 64. A profiled abutment 76 is also formed on each leg portion 60 spaced from the lugs 72, 74. The abutment 76 has a straight side 78 directed toward the legs and an arcuate opposite side 80 including an exterior groove 82. The main portion 84 of the cover 12 includes a plurality of apertures 86 each aligned to receive a respective terminal 24 of the connector housing 12.

Figure 2:
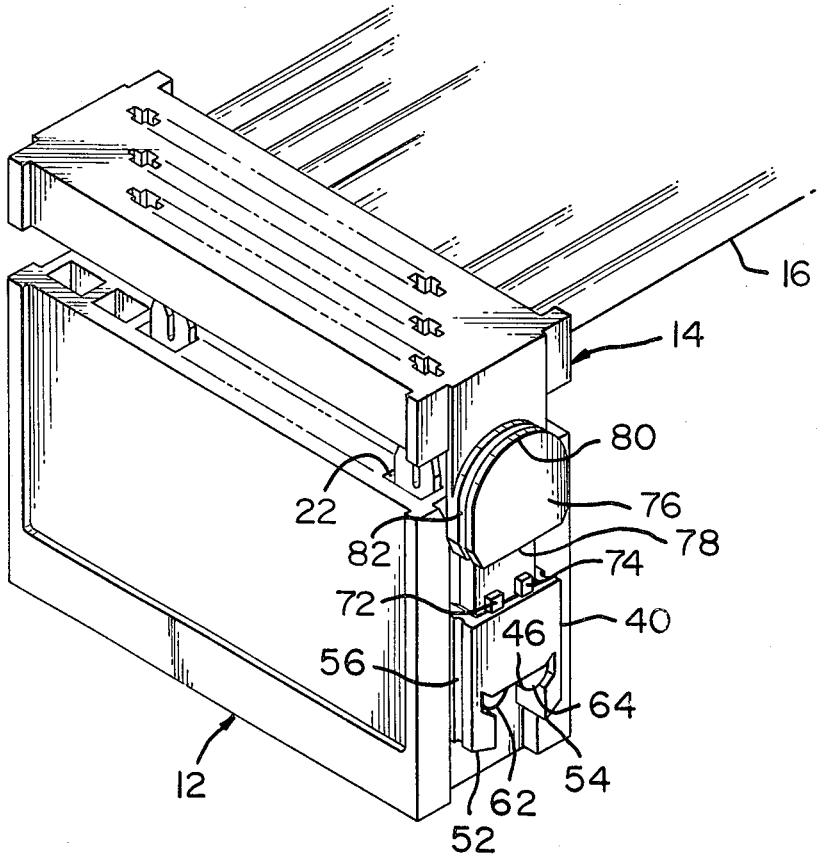
FIG. 2 is a perspective view of the subject invention in the first open condition.

The cover 14 is preferably preassembled with the housing 14 into the open condition shown in FIG. 2. In this position the shoulders 68, 70 of the respective legs 62, 64 engage in the recesses 48, 50 of the profiled side 44 of the bridge 40 and lugs 72, 74 engage the first side 42 to hold the cover 14 with its cable engaging surface spaced above the conductor piercing portions 26 of the terminals 24. In this position, the cover is secured against accidental displacement with respect to the connector housing. When it is desired to terminate a cable 16, the cable is placed between the cover 14 and the connector housing 12, as shown in FIG. 2, and the cover is driven against the connector to the closed position shown in FIG. 3. This will carry conductors of the cable 16 into engagement with the insulation piercing portions 26 of the respective terminals 24 and also wipe off the lugs 72, 74 against the bridge 40. The outwardly directed shoulders 68, 70 of the legs 62, 64 will engage with the bottom shoulders 52, 54, respectively, of the bridge 40 while the side 78 of abutment 76 engages the first side 42.

Figure 3:
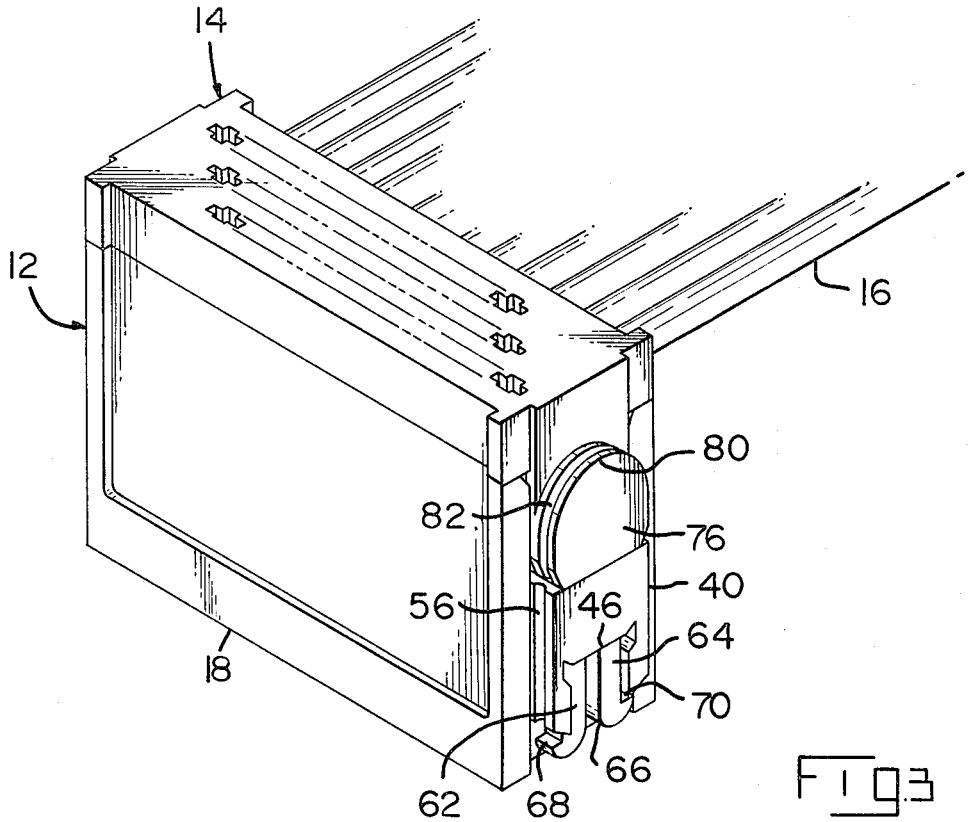
FIG. 3 is a perspective view of the subject invention in the second closed condition.

It will be appreciated that when the connector such as that shown in FIG. 3 is mated in a high density arrangement, that there will be very little room between adjacent connectors to receive a removal tool (not shown). This configuration of the present invention allows a profile which can be readily engaged to extract the subject connector. The grooves 56, 58, 82, assist in the reception of the removal tool.

We claim:

1. An improved electrical connector for terminating multi-conductor flat flexible cable, said connector comprising:

an elongated housing member of insulating material having oppositely directed mating and cable receiving faces, a plurality of terminal passages extending between said faces, an outwardly directed latching channel at each end of said housing, a transverse bridge spanning said channel intermediate said mating and said cable receiving faces, each said bridge having a straight side directed toward said cable receiving face and a profiled side directed toward said mating face said profiled side defining a blind opening the closed end of which has outwardly directed recesses forming a first portion, the sides adjacent said opening forming a second portion;

a like plurality of terminals each mounted in a respective passage with a mating portion directed toward said mating face and a conductor engaging portion extending from said cable receiving face; and an elongated cover of insulating material having a cable engaging surface, a like plurality of apertures in said surface each aligned with a respective passage in said housing member, and a leg assembly depending from each end of said cover to be received in a respective channel and defined by a pair of legs separated by a slot, a shoulder on the free end of each leg outwardly directed from said slot, at least one lug extending normal to the plane defined by said legs and being adjacent the closed end of the slot, and an abutment spaced from said slot and extending transversely with respect to said lugs;

whereby said shoulders of said legs engage said first portion of said profiled side of said bridge while said lug engages opposite the side of said bridge to hold said cover in a first position with said cable engaging surface spaced from said cable receiving face and said lugs are sheared off against said bridge so that said latching shoulders engage said second portion of said profiled side to hold said cover in a second position with said abutment engaging said straight side of said bridge.

2. An improved electrical connector according to claim 1 wherein said bridges define extraction tool engaging surfaces whereby said connector can be readily removed from a high density array.

* * * * *